US010593185B2

(12) United States Patent
Brasch et al.

(10) Patent No.: US 10,593,185 B2
(45) Date of Patent: Mar. 17, 2020

(54) SYSTEM AND METHOD FOR ACTIVE MONITORING OF A PERSON

(71) Applicant: J. Brasch Co., LLC, Lincoln, NE (US)

(72) Inventors: John Joseph Brasch, Lincoln, NE (US); Gordon Smith, Jr., Lincoln, NE (US)

(73) Assignee: J. Brasch Co., LLC, Lincoln, NE (US)

( * ) Notice: Subject to any disclaimer, the term of this patent is extended or adjusted under 35 U.S.C. 154(b) by 0 days.

(21) Appl. No.: 15/156,326

(22) Filed: May 16, 2016

(65) Prior Publication Data

US 2017/0004695 A1 Jan. 5, 2017

Related U.S. Application Data

(60) Provisional application No. 62/161,998, filed on May 15, 2015, provisional application No. 62/163,114, filed on May 18, 2015.

(51) Int. Cl.

| | |
|---|---|
| ***G08B 21/22*** | (2006.01) |
| ***G08B 21/04*** | (2006.01) |
| ***G08B 21/24*** | (2006.01) |
| *G08B 25/00* | (2006.01) |

(52) U.S. Cl.

CPC ..... *G08B 21/0423* (2013.01); *G08B 21/0415* (2013.01); *G08B 21/0461* (2013.01); *G08B 21/24* (2013.01); *G08B 25/001* (2013.01); *G08B 25/005* (2013.01)

(58) Field of Classification Search

CPC ..... G08B 21/04

See application file for complete search history.

(56) References Cited

U.S. PATENT DOCUMENTS

| | | | | |
|---|---|---|---|---|
| 6,359,557 | B2 | 3/2002 | Bilder | |
| 8,446,274 | B1 | 5/2013 | Crook | |
| 2007/0153993 | A1 | 7/2007 | Cohen | |
| 2011/0294457 | A1 * | 12/2011 | Braznell | G08B 21/0227 455/404.1 |

(Continued)

FOREIGN PATENT DOCUMENTS

| | | |
|---|---|---|
| CN | 101854385 A | 10/2010 |
| WO | 2012115675 | 8/2012 |

OTHER PUBLICATIONS

International Preliminary Report on Patentability for WO2016185369.

*Primary Examiner* — Joseph H Feild
*Assistant Examiner* — Pameshanand Mahase
(74) *Attorney, Agent, or Firm* — Michael D. Eisenberg

(57) ABSTRACT

A system for monitoring a person comprises establishing a check-in period, wherein the system checks for a check-in from local devices, local to the person monitored during the check-in period. If no check-in is received during the check-in period, sending a message to a remote communication device, from a first user different than the monitored person. If no check-in is received from the first user, sending a message to additional remote communication devices stored in memory until a check-in is received or until all devices stored in memory are exhausted without a check-in. If a check-in is received from a local device or a remote communication device, stopping the check-in period and stopping sending messages to remote communication devices and waiting for the next scheduled check-in period to check for check-ins.

11 Claims, 6 Drawing Sheets

(56) References Cited

U.S. PATENT DOCUMENTS

| | | | | |
|---|---|---|---|---|
| 2014/0327540 | A1* | 11/2014 | Shin | G08B 21/0446<br>340/539.11 |
| 2015/0025790 | A1* | 1/2015 | Hwang | G08B 25/10<br>701/411 |
| 2016/0295300 | A1* | 10/2016 | Alman | H04N 21/814 |

* cited by examiner

SYSTEM AND METHOD FOR ACTIVE MONITORING OF A PERSON

CROSS-REFERENCES TO RELATED APPLICATIONS

The present application claims priority from U.S. Provisional Application Ser. No. 62/161,998 filed on May 15, 2015 and U.S. Provisional Application Ser. No. 62/163,114 filed on May 18, 2015, both of which are hereby incorporated herein by reference in their entirety.

BACKGROUND

Elderly individuals living alone face a potential hazard of being incapacitated by a fall or a health condition that renders them unable to call for help, reach a device to summon help or otherwise. Current methods may require a person to carry a device around with them. The drawback is that the person may forget to carry it, they may feel ashamed to carry it or other reasons. The present invention addresses this problem.

BRIEF SUMMARY OF THE INVENTION

A system for monitoring a person comprises establishing a check-in period, wherein the system checks for a check-in from local devices, local to the person monitored during the check-in period. If no check-in is received during the check-in period, sending a message to a remote communication device, from a first user different than the monitored person. If no check-in is received from the first user, sending a message to additional remote communication devices stored in memory until a check-in is received or until all devices stored in memory are exhausted without a check-in. If a check-in is received from a local device or a remote communication device, stopping the check-in period and stopping sending messages to remote communication devices and waiting for the next scheduled check-in period to check for check-ins.

In a variant of the system, if a check-in is received from a user of a remote communication device, then executing a follow up process within a second predetermined time period, wherein the system sends a message to the user from which the check-in was received, and awaits a check-in. If no check-in is received, sending a message to additional remote communication devices stored in memory until a check-in is received or until all devices stored in memory are exhausted without a check-in.

In another variant of the system, during period where messages are being sent to the remote communication devices, sending a message to the local communication devices and if a check-in is received at the local communication device of the monitored person, then stopping the check-in period and stopping sending messages to remote communication devices and waiting for the next scheduled check-in period to check for check-ins.

In a further variant of the system, wherein prior to the system checking for a check-in from local devices, and prior to sending messages to remote communication devices, receiving a check-in from the monitored person and then stopping the check-in period and stopping sending messages to remote communication devices and waiting for the next scheduled check-in period to check for check-ins.

In still another variant of the system, if a check-in is received from a user of a remote communication device, sending notifications to any other user of a remote communication device previously sent a message.

In yet a further variant, a computer implemented method for monitoring a person, is operable on a processor in communication with a memory having instructions stored thereon, and comprises: receiving a schedule of sensor events; if a sensor event fails to occur, generating a pre-alert signal to a local communication device; querying the monitored person at the local communication device, to cancel the pre-alert; if no response is received from the local communication device, then issuing an alert to remote communication devices according to a predefined sequence.

In a variant of the method, wherein if a response to the alert is received from the remote communication device, then cancelling the sequence of issuing alerts. If no response is received from all the remote communication devices in the sequence within a predetermined time, then cancelling the sequence of issuing alerts.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

Figure 1:
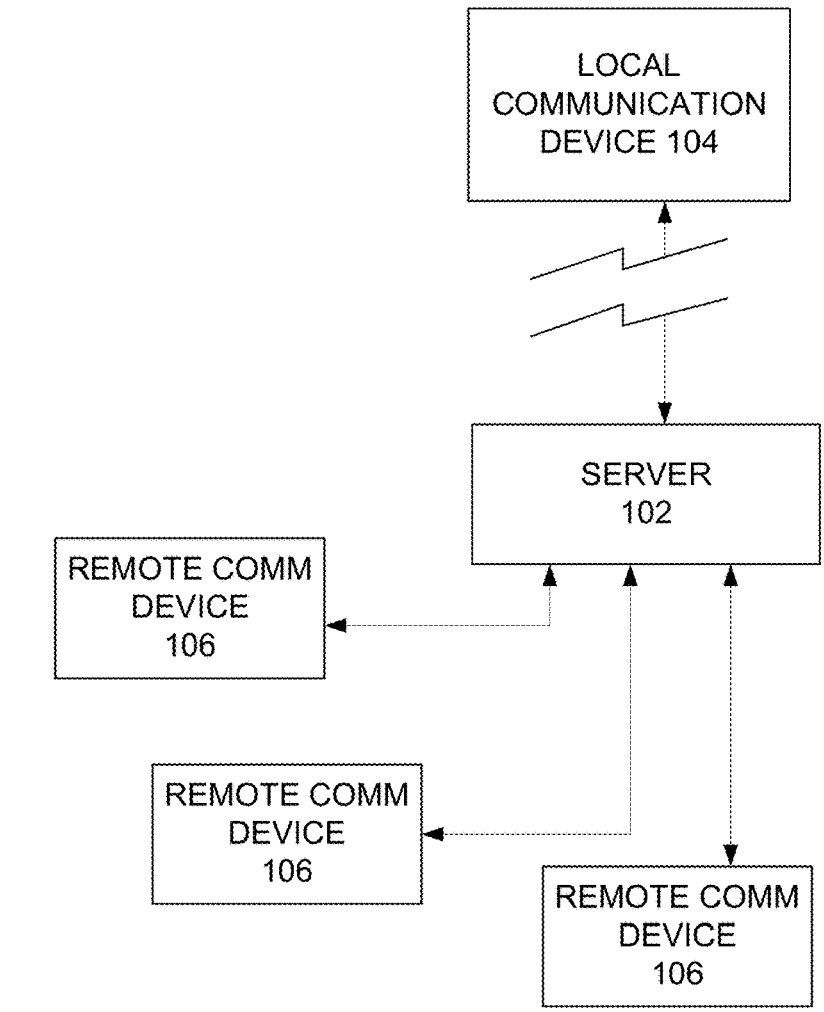
FIG. 1 is a block diagram of a patient monitoring system.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The present invention is directed toward a patient monitoring system 100. The system 100 includes a server 102 configured for remotely communicating with one or more local communication device 104 associated with the person to be monitored and with one or more remote communication devices 106 associated with caretakers of the monitored person, such as family, friends, hired help, and medical personnel, for example. The communication between the server and the local and remote communication device may use one or more communication techniques, such as wireless internet, phone lines, cellular network, broadband internet lines, etc. The local and remote communication devices may be cellular phones, smart phones, tablets, laptop computers etc. Optionally, the local and communication devices may also include non-portable devices, such as desktop computers, smart televisions, and gaming consoles.

In one non-limiting example, the local device 104 is a tablet that is near the monitored person and may be carried by the monitored person. The local device 104 wirelessly communicates with a local router, which is in communication with the server via the internet. The remote communication devices may be cell phones, which communicate with the server via the cellular network. In another non-limiting example, the local devices and the remote devices communicate with the server via the cellular network. In another non-limiting example, the communication between the local and remote devices may bypass the server, and occur, for example via the cellular network.

Figure 2:
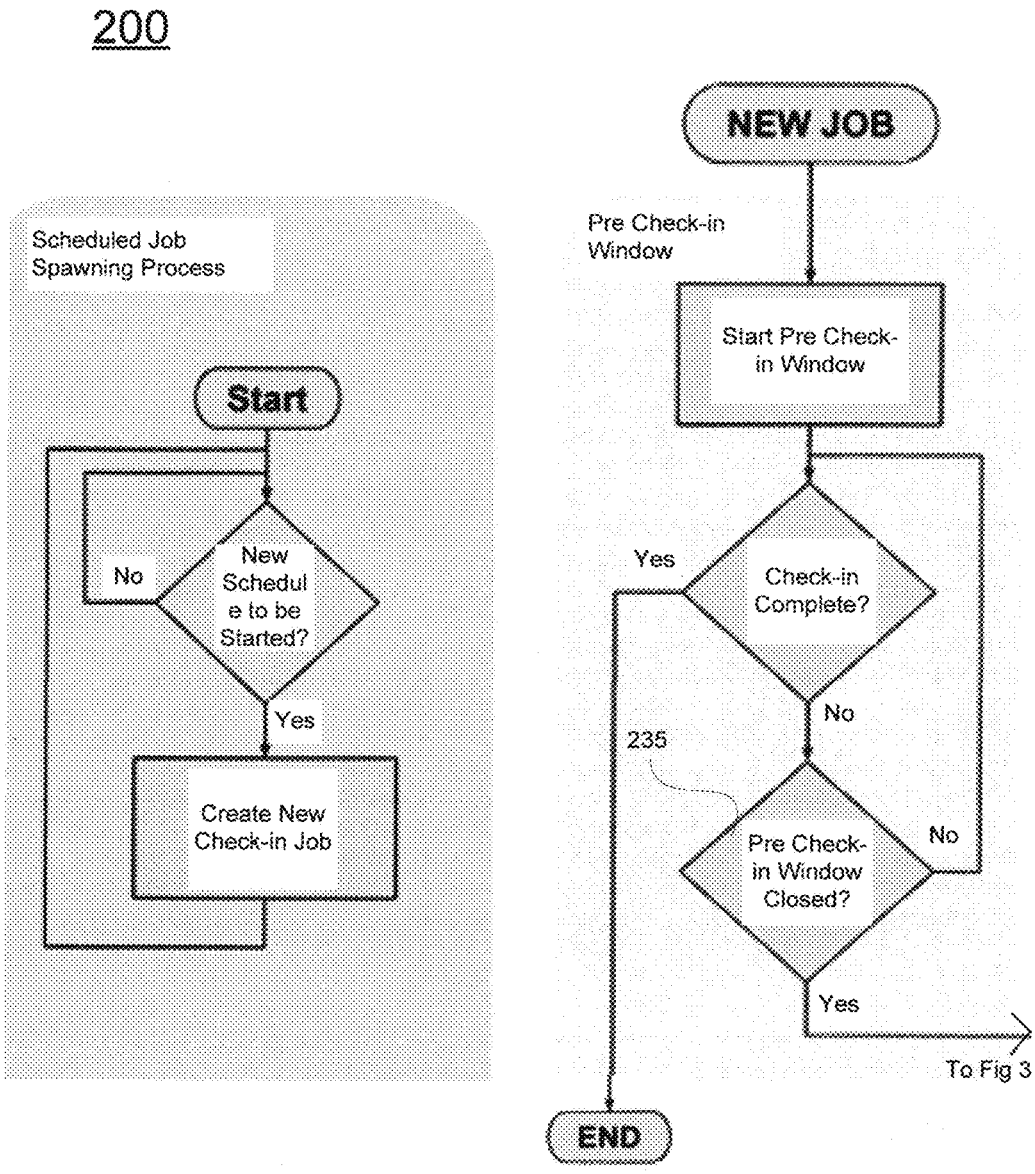
FIGS. 2-4 is a flow chart illustrating a process of a patient monitoring system.
Figure 3:
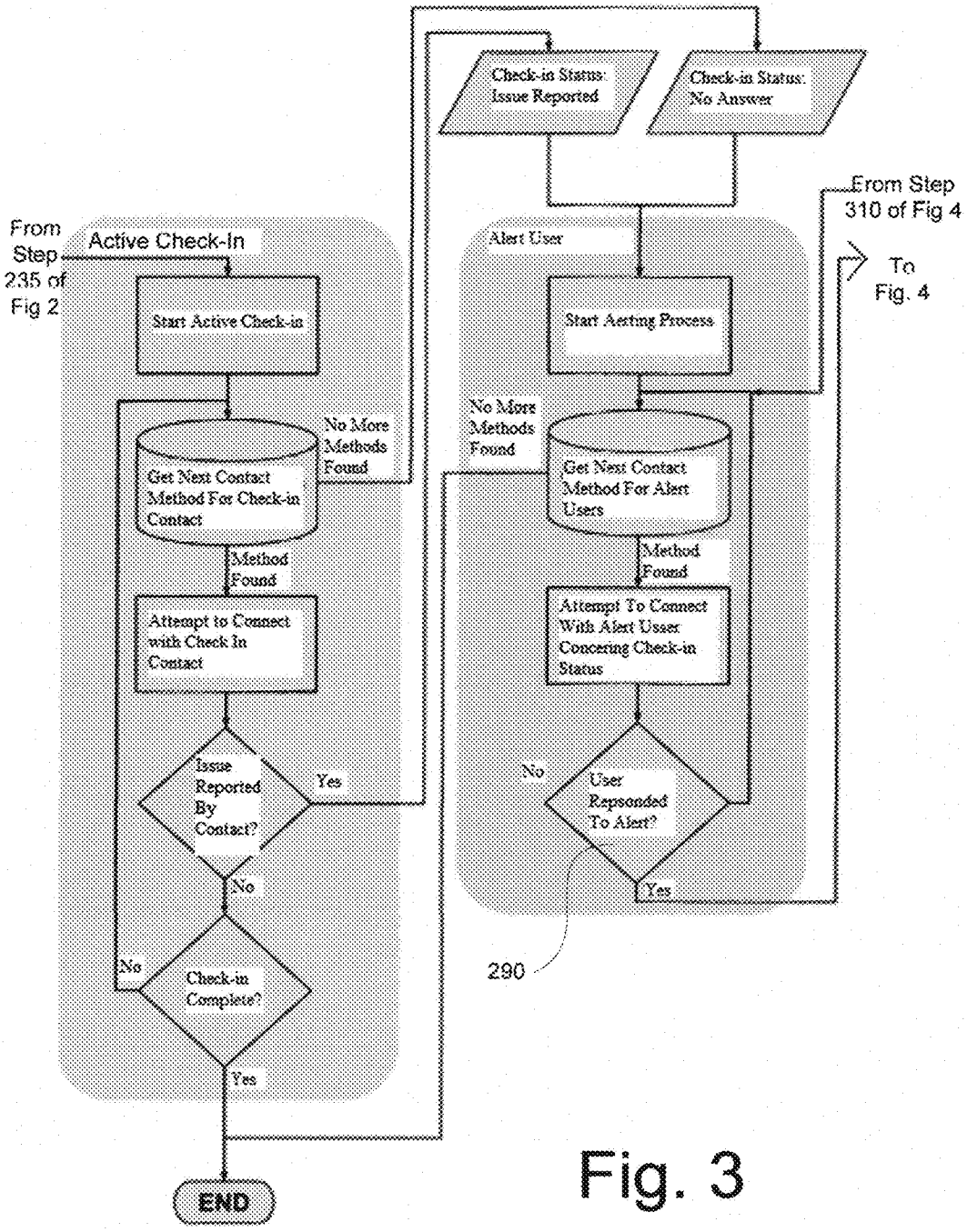
Figure 4:
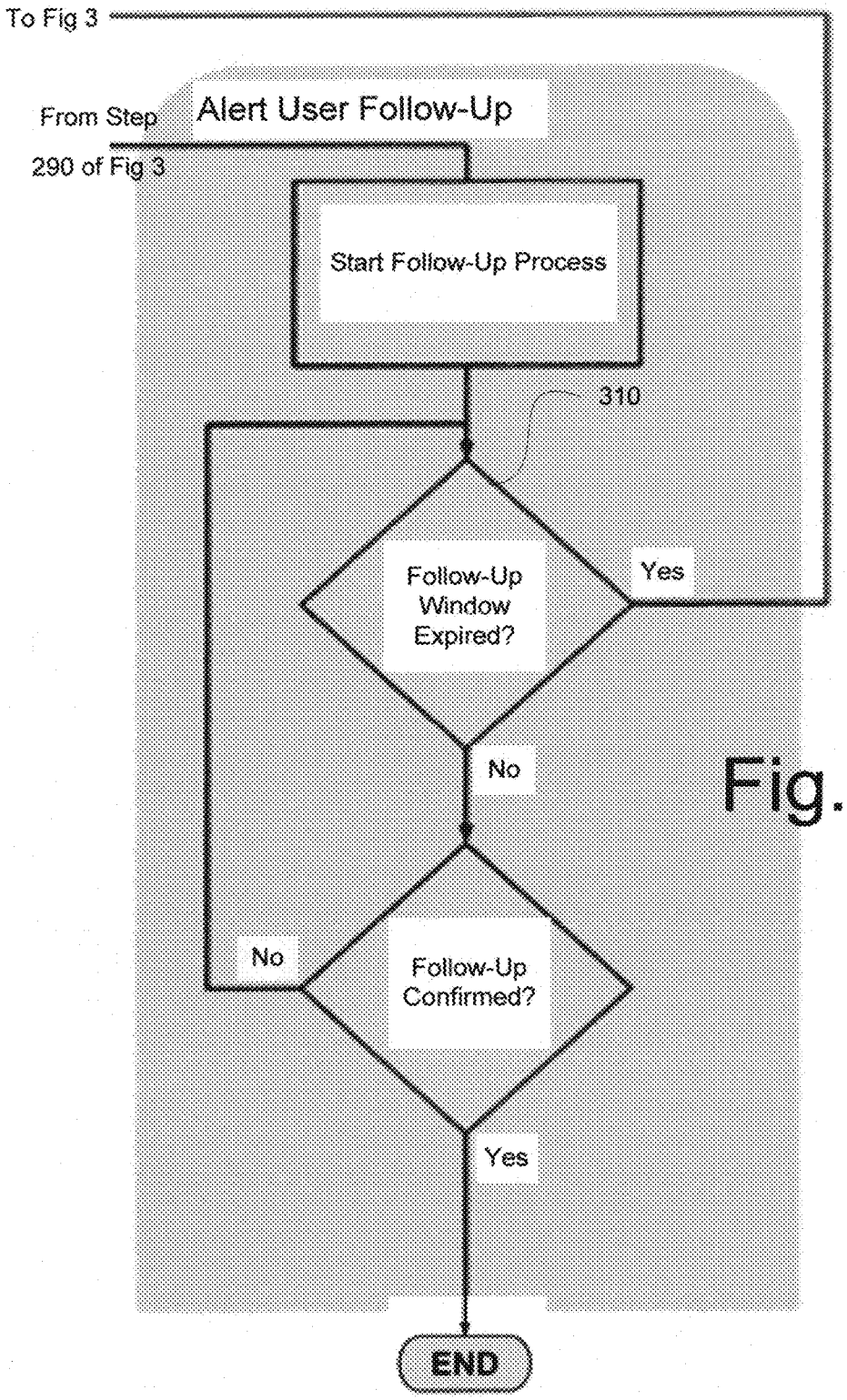

FIGS. 2-4 is a flowchart illustrating an example of the server's operation, according to some embodiments of the present invention.

The server 102 checks a predetermined schedule, to determine if it is time to start a new a job (reminder or check-in). If a new job is to be started, the server starts a new job. Otherwise, the server keeps checking at a predetermined frequency.

Once a new job is started, the server 102 is configured for pushing reminders to the local devices 104. The reminders may include, for example, reminders to take a medicine, or reminders to get out and take a walk, and/or simply to confirm that all is in order (check-in reminders). The local devices notify the monitored person of the reminders visually, by sound, and/or haptically, and to prompt the monitored person to respond to the reminders. The response may be, for example in the form of pushing a virtual or real button, performing a gesture on a touch screen, or saying a certain word or phrase.

If the monitored person does not respond within a certain time interval, the server enters an alert mode and contacts one or more remote communications devices 108 to notify that the monitored person has not responded to the reminder. The communication from the server to remote communication devices may be in the in the form of an SMS message, text message, phone calls, etc. The server will wait from a response from the remote users, and will try different communication methods, until no more methods are found. If one of the remote users responds to the alert notification, or if all known methods have been used and no response has been received within a certain time period, the server will exit alert mode and return to its normal operation. Optionally, if one remote user has responded to the alert notification, the server informs all other contacted remote users that a response has been received and the issue is being taken care of.

In some embodiments of the present invention, the alert notification may be also sent to the local communication device(s) of the monitored person, allowing the monitored person to stop the alert and notify the issue is being taken care of.

In some embodiments of the present invention, the monitored person may respond by reporting an issue. For example, buttons may be available for on the screen each button being associated with an issue (e.g. a general button for reporting "There's a problem, please call", and/or more specific buttons such as "I fell", "I am out of medicine", etc.). Optionally, the monitored person may report an issue by describing the issue by voice, or by typing. If an issue is reported, the alert notification that is sent to the remote communication may include a description of the issue.

Optionally, after the alert has ended because of the response of a remote user, a follow-up process is started. The follow-up process is optionally started a certain time interval after the response of the remote user. In the follow-up process, the server sends to remote communication device(s) associated with the user who has responded to the alert notification, a prompt. If a response is received by the server from the remote communication device(s) within a certain time period, the job relating to the reminder/check-in is ended. If no response is received, the server reverts to the alert mode described above.

Optionally, prior to the pushing of the reminder, the monitored person, may actively check in and notify the server that he or she has performed a certain action. For example, the person may open a program (application) on the local communication device, which provides options for reporting the performed action, such as virtual button associated with an action. Alternatively, a pre-check in window appears on the device, but the monitored person is not notified of the opening of the pre-check in window. Rather, the monitored person needs to actively turn on the device or the device's screen to close the window and report that the action has been performed. If the pre-check in window has not been closed within a certain time period, then the active check-in phase described above occurs.

In some embodiments of the present invention, software may be installed in at least the local devices for appropriately notifying the monitored person of the reminder.

Figure 5:
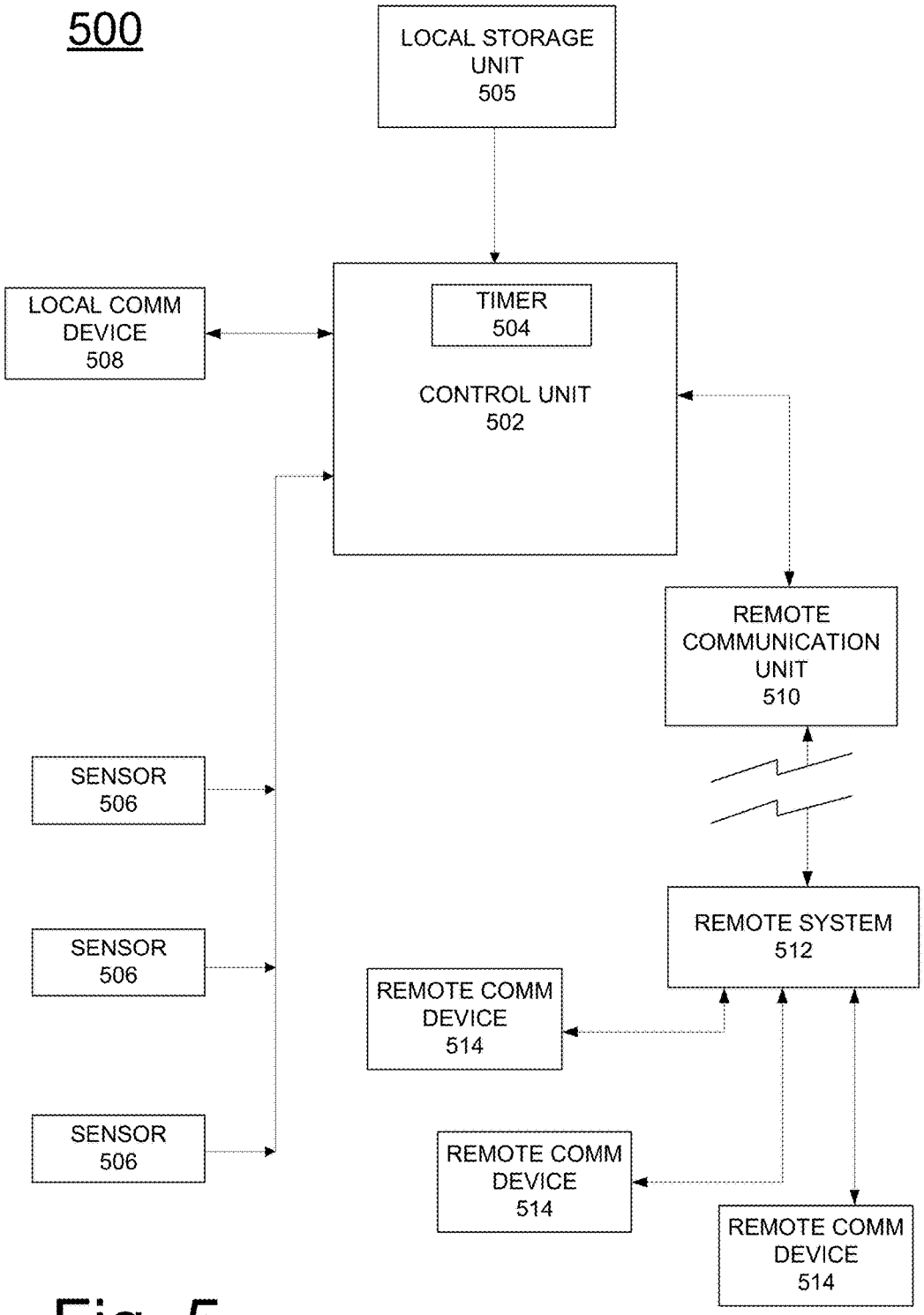
FIG. 5 is a block diagram of a patient monitoring system with a pre-alert system.
Figure 6:
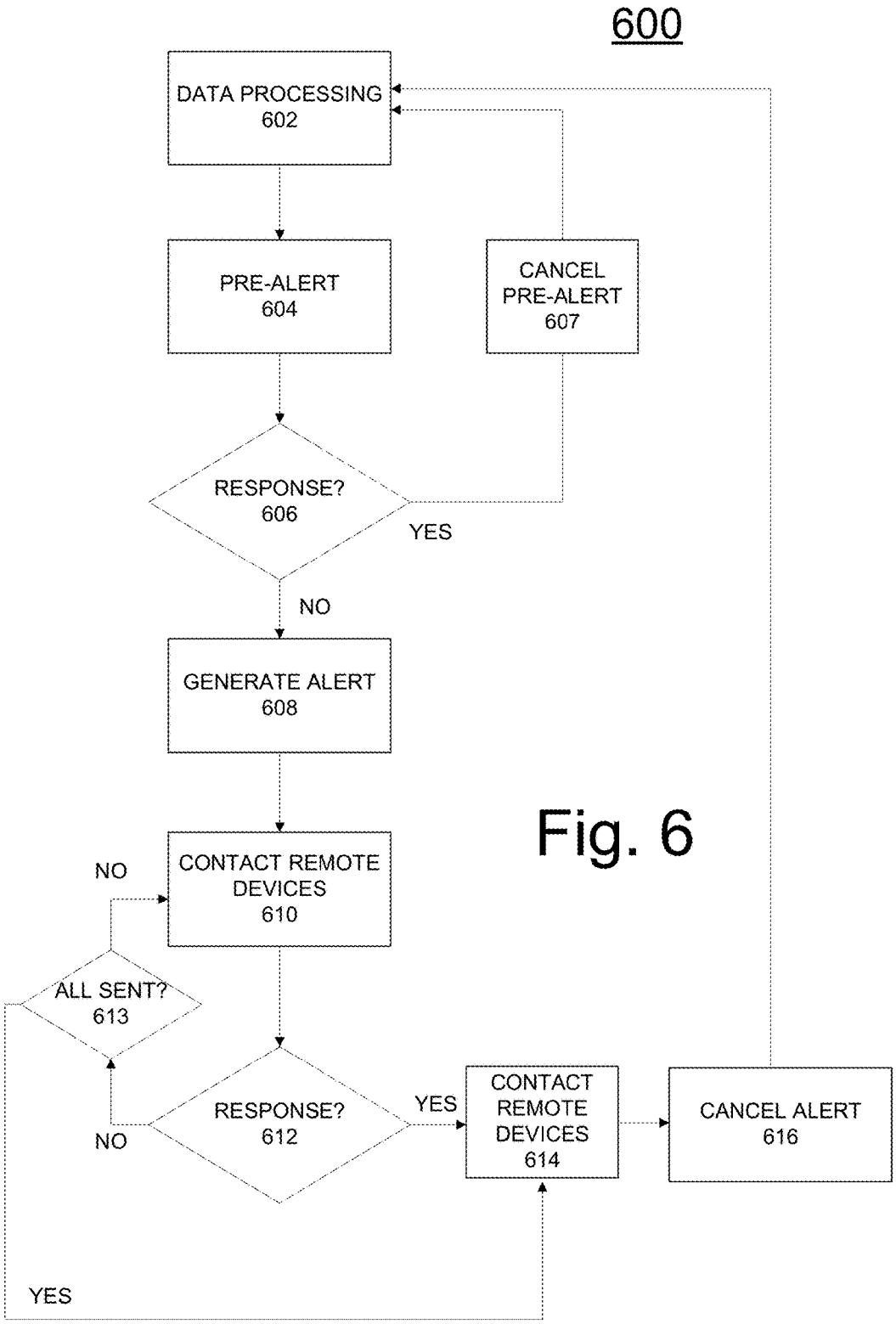
FIG. 6 is a flow chart of a patient monitoring system with a pre-alert system.

In a variant, a patient monitoring system with a pre-alert system is provided 500. FIG. 5 illustrates a block diagram of the system. The system 500 comprises a control unit 502 (having a timer 504 and associated with a memory module 505), and a one or more sensors 506. The sensors are place at various locations in a person's house or room, and arte configured for tracking the activities of the person. For example, a first sensor may be a pressure pad placed on or under the person's bed to determine whether the person is present in or absent from the bed. A second sensor may be near the door of the person's room, to determine whether the person has left the room. A third sensor may be at the bathroom's door, to determine entry into or exit from the bathroom. A fourth sensor may be associated with a coffee machine, to determine whether the coffee machine is being used. Any number of sensors may be present and are in wired or wireless communication with the control unit. Referring to FIG. 6, in a step 602, the control unit receives data from the sensors and analyzes the data from the sensors to determine whether an uncommon or undesirable condition has occurred, according to rules stored in the memory unit and according to a time measured by the timer. If the condition has occurred, in a step 604, then the control unit generates a pre-alert signal.

For example, if sensor data indicates that person who usually gets up by a predetermined time is still in bed after that time, the pre-alert signal is generated. If a sensor has detected that a person has entered the bathroom, but no reading indicates the person's exiting the bathroom within a predetermined time interval, a pre-alert signal is generated. If a person usually makes coffee in a predetermined time period, and no sensor signal has been received in that time period to indicate an operation of the coffee machine, then a pre-alert signal is generated.

The pre-alert signal is sent to a local communication device 508 is wired or wireless communication with the control unit 502. The communication unit may include one or more stationary units located in the person's house, a phone, a tablet, or a dedicated device that can be carried by the person. The communication between the control unit 502 may be direct or may be executed via an external network, such as the cellular network.

The pre-alert signal is converted into a pre-alert warning that warns the person that an undesirable condition has been detected. The warning may be an audio warning, a visual warning, and/or a haptic warning. If the undesirable condition is a false alarm, or if the undesirable condition is not indicative of the person's distress, the person can respond at step 606 to the warning to stop the warning at step 607 and let the system 500 return to its normal operation.

In some embodiments of the present invention, the system 500 can connect to one or more remote communication devices 514 associated with one or more caretakers of the person (such as family members, friends, medical personnel), in order to notify the caretakers that the condition has been determined. The system includes a remote communication unit 510 that connects to a remote system 512 configured for sending notification to the remote devices. The remote system may connect to the remote communication devices via the cellular network. The notifications may be delivered by audio, visual, and/or haptic means.

If no response to the pre-alert warning is received by the control unit at step 606, the control unit generates an alert signal. At step 610, the alert signal is sent to the local communication device 508 and to remote system 512, from which, at step 608, it is sent to the remote communication devices 514. The alert signal is converted into an alert warning by the local and remote communication devices. The alert warning may be, a phone call, an SMS, an audio warning, a visual warning, and/or a haptic warning.

In some embodiments of the present invention, if at a step 612, a response from a remote communication device to the remote system may cause the remote system to notify other remote communication systems at step 614, that someone is taking care of the problem, and at step 616, instruct the control unit to cancel the alert and return to its normal operation. Optionally, a response from the local communication device also cause the remote system to notify other remote communication systems that someone is taking care of the problem, and instruct the control unit to cancel the alert and return to its normal operation.

Optionally, the remote system tries to reach the remote communication devices a certain number of times. If all alert signals have been sent a certain number of times and at steps 612 and 613, if no response has been received by the local communication device or by the remote communication devices, at step 614 the remote system notifies the remote communication devices that no response to an alert. At step 616 the remote system then instructs the control unit to cancel the alert and return to its normal operation.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. A system for monitoring a person, comprising a processor and a memory module having instructions stored thereon, that when executed, cause the processor to:

establish a check-in period, wherein the system checks for a check-in from one or more local devices, local to the person monitored during the check-in period;

if no check-in is received from the one or more local devices during the check-in period, sending a message to a remote communication device associated with a first user different than the monitored person;

if no check-in is received from the first user, sending the message to additional remote communication devices stored in memory until a check-in is received or until all devices stored in memory are exhausted without a check-in;

if a check-in is received from a local device or a remote communication device after the check-in period has elapsed, stopping sending the messages to remote communication devices and waiting for the next scheduled check-in period to check for check-ins;

if a check-in is received from a user of a remote communication device, executing a follow up process within a second predetermined time period, wherein the system sends a second message to the user from which the check-in was received, and awaits a second check-in from the user from which the check-in was received; if no second check-in is received within a certain time following a start of the follow up process, sending the message to additional remote communication devices stored in memory until a check-in is received or until all devices stored in memory are exhausted without a check-in.

2. The system of claim 1, wherein during period where the messages are being sent to the remote communication devices, sending the message to the one or more local communication devices and if a check-in is received from the local communication device of the monitored person, then stopping the check-in period and stopping sending the messages to remote communication devices and waiting for the next scheduled check-in period to check for check-ins.

3. The system of claim 1, wherein prior to the system checking for a check-in from local devices, receiving a check-in from the monitored person and then stopping the check-in period and waiting for the next scheduled check-in period to check for check-ins.

4. The system of claim 1, wherein if a check-in is received from a user of a remote communication device, sending notifications that a response has been received and the issue is being taken care of to any other user of a remote communication device to which the message has been previously sent and who has not sent a check-in in response to the message.

5. The system of claim 1, wherein prior to sending the messages to the remote communication devices, receiving a check-in from the monitored person, the check-in comprising a report of an issue, and responsive to the issue, sending the message to the additional remote communication devices stored in memory until the check-in is received or until all devices stored in memory are exhausted without the check-in.

6. A computer implemented method for monitoring a person, operable on a processor in communication with a memory having instructions stored thereon, comprising:

receiving a schedule of sensor events;

if a sensor event fails to occur, generating a pre-alert signal to a local communication device;

querying the monitored person at the local communication device, to cancel the pre-alert;

if no response is received from the local communication device, then issuing an alert to remote communication devices according to a predefined sequence;

if a response to the alert is received from at least one of the remote communication device, then cancelling the sequence of issuing alerts, and waiting for the next sensor event;

if no response to the alert is received from any of the remote communication devices in the sequence within a predetermined time, then cancelling the sequence of issuing alerts and waiting for the next sensor event.

7. A system for monitoring a person, comprising a processor and a memory module having instructions stored thereon, that when executed, cause the processor to:

establish a check-in period, wherein the system checks for a check-in from one or more local devices, local to the person monitored during the check-in period;

if no check-in is received from the one or more local devices during the check-in period, sending a message to a remote communication device associated with a first user different than the monitored person;

if no check-in is received from the first user, sending the message to additional remote communication devices stored in memory until a check-in is received or until all devices stored in memory are exhausted without a check-in;

if a check-in is received from a local device or a remote communication device after the check-in period has elapsed, stopping sending the messages to remote communication devices and waiting for the next scheduled check-in period to check for check-ins;

if a check-in is received from a user of a remote communication device, sending notifications that a response has been received and the issue is being taken care of to any other user of a remote communication device to which the message has been previously sent and who has not sent a check-in in response to the message.

8. The system of claim 7, wherein if a check-in is received from a user of a remote communication device, executing a follow up process within a second predetermined time period, wherein the system sends a second message to the user from which the check-in was received, and awaits a second check-in from the user from which the check-in was received; if no second check-in is received within a certain time following a start of the follow up process, sending the message to additional remote communication devices stored in memory until a check-in is received or until all devices stored in memory are exhausted without a check-in.

9. The system of claim 7, wherein during period where the messages are being sent to the remote communication devices, sending the message to the one or more local communication devices and if a check-in is received from the local communication device of the monitored person, then stopping the check-in period and stopping sending the messages to remote communication devices and waiting for the next scheduled check-in period to check for check-ins.

10. The system of claim 7, wherein prior to the system checking for a check-in from local devices, receiving a check-in from the monitored person and then stopping the check-in period and waiting for the next scheduled check-in period to check for check-ins.

11. The system of claim 7, wherein prior to sending the messages to the remote communication devices, receiving a check-in from the monitored person, the check-in comprising a report of an issue, and responsive to the issue, sending the message to the additional remote communication devices stored in memory until the check-in is received or until all devices stored in memory are exhausted without the check-in.

* * * * *